US008216116B2

(12) United States Patent
Canali

(10) Patent No.: US 8,216,116 B2
(45) Date of Patent: Jul. 10, 2012

(54) MACHINE FOR GYMNASTIC EXERCISES, PARTICULARLY FOR MUSCLE STRETCHING

(76) Inventor: Vincenzo Canali, Tizzano val Parma (IT)

( * ) Notice: Subject to any disclaimer, the term of this patent is extended or adjusted under 35 U.S.C. 154(b) by 0 days.

(21) Appl. No.: 12/970,669

(22) Filed: Dec. 16, 2010

(65) Prior Publication Data

US 2011/0152034 A1 Jun. 23, 2011

(30) Foreign Application Priority Data

Dec. 22, 2009 (IT) ..... MI2009A2267

(51) Int. Cl.
*A63B 21/00* (2006.01)

(52) U.S. Cl. ..... 482/130; 482/121; 482/142

(58) Field of Classification Search ..... 482/95, 482/96, 121, 72, 51
See application file for complete search history.

(56) References Cited

U.S. PATENT DOCUMENTS 4,819,936 A 4/1989 Muller
5,580,340 A * 12/1996 Yu ..... 482/96
6,152,866 A * 11/2000 Kuo ..... 482/142
2002/0013199 A1* 1/2002 Giannelli et al. ..... 482/95
2006/0160674 A1 7/2006 Andrews
2008/0261783 A1 10/2008 Andrews

FOREIGN PATENT DOCUMENTS

WO 2004110565 A1 12/2004

OTHER PUBLICATIONS

European Search Report from MI20092267 dated Jul. 5, 2010.

* cited by examiner

*Primary Examiner* — Jerome W Donnelly
(74) *Attorney, Agent, or Firm* — Lando & Anastasi, LLP

(57) ABSTRACT

A machine for gymnastic exercises, particularly for muscle stretching, comprising a supporting frame, a seat which is fixed with respect to the supporting frame, and a back rest which is pivoted to the supporting frame for moving the back rest between a position which is substantially inclined with respect to the seat and a position which is substantially perpendicular with respect to the seat, the machine further comprising a carriage which is slidingly associated with the supporting frame and is functionally connected to the back rest by way of kinematic connection elements for transferring the motion of the carriage to the back rest and/or vice versa.

10 Claims, 9 Drawing Sheets

MACHINE FOR GYMNASTIC EXERCISES, PARTICULARLY FOR MUSCLE STRETCHING

The present invention relates to a machine for gymnastic exercises, particularly for muscle stretching of the joints involved in the posterior kinematic chain of the human body.

BACKGROUND OF THE INVENTION

In the field of sports activities, of physiotherapy, of rehabilitation gymnastics and the like, machines for gymnastic exercises are known which make it possible to stretch various different muscle groups by acting on a single joint.

These known types of machine are not devoid of drawbacks, which include the fact that they are built to act only on one muscle group at a time without involving the other neighboring muscle groups in the exercise.

In particular, this drawback is relevant if one considers that some muscle groups, such as for example the muscles that belong to the posterior kinematic chain, as is known, are particularly subject to trauma, stress, fatigue and various disorders which are caused for example by incorrect postures assumed in everyday life or injuries of various kinds and, therefore, the stretching of a single muscle group might not be sufficient to achieve the sought beneficial goals.

SUMMARY OF THE INVENTION

The aim of the present invention is to provide a machine for gymnastic exercises, particularly for muscle stretching, that makes it possible to put the posterior muscles of the user of the machine in a stretched condition simultaneously with the other joints involved in the posterior kinematic chain.

Within this aim, an object of the present invention is to provide a machine for gymnastic exercises that is operated voluntarily, according to movements which are natural and easy to perform in practice, and does not entail the use of weights.

Another object of the present invention is to provide a machine for gymnastic exercises that is structurally simple, easy to provide and at competitive costs when compared to machines of the known type.

This aim, as well as these and other objects that will become better apparent hereinafter, are achieved by a machine for gymnastic exercises, particularly for muscle stretching, comprising a supporting frame, a seat which is fixed with respect to said supporting frame, and a back rest which is pivoted to said supporting frame for moving said back rest between a position which is substantially inclined with respect to said seat and a position which is substantially perpendicular with respect to said seat, characterized in that it comprises a carriage which is slidingly associated with said supporting frame and is functionally connected to said back rest by way of kinematic connection means for transferring the motion of said carriage to said back rest and/or vice versa.

BRIEF DESCRIPTION OF THE DRAWINGS

Further characteristics and advantages of the present invention will become better apparent from the description of a preferred but not exclusive embodiment of a machine for gymnastic exercises, particularly for muscle stretching, according to the invention, illustrated by way of non-limiting example in the accompanying drawings, wherein.

DESCRIPTION OF THE PREFERRED EMBODIMENTS

Figure 1:
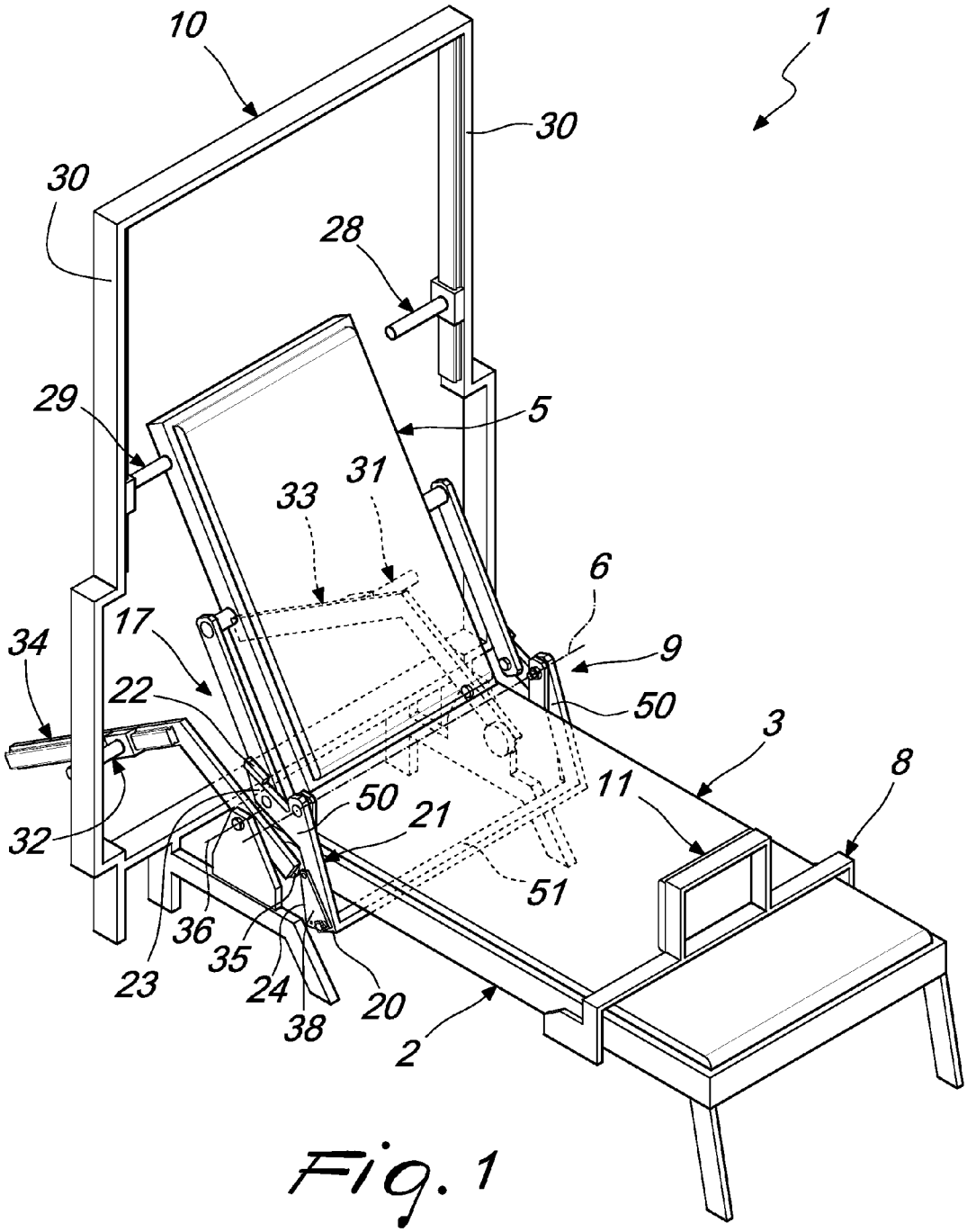
FIG. 1 is a perspective view of machine for gymnastic exercises, particularly for muscle stretching, according to the invention.
Figure 2:
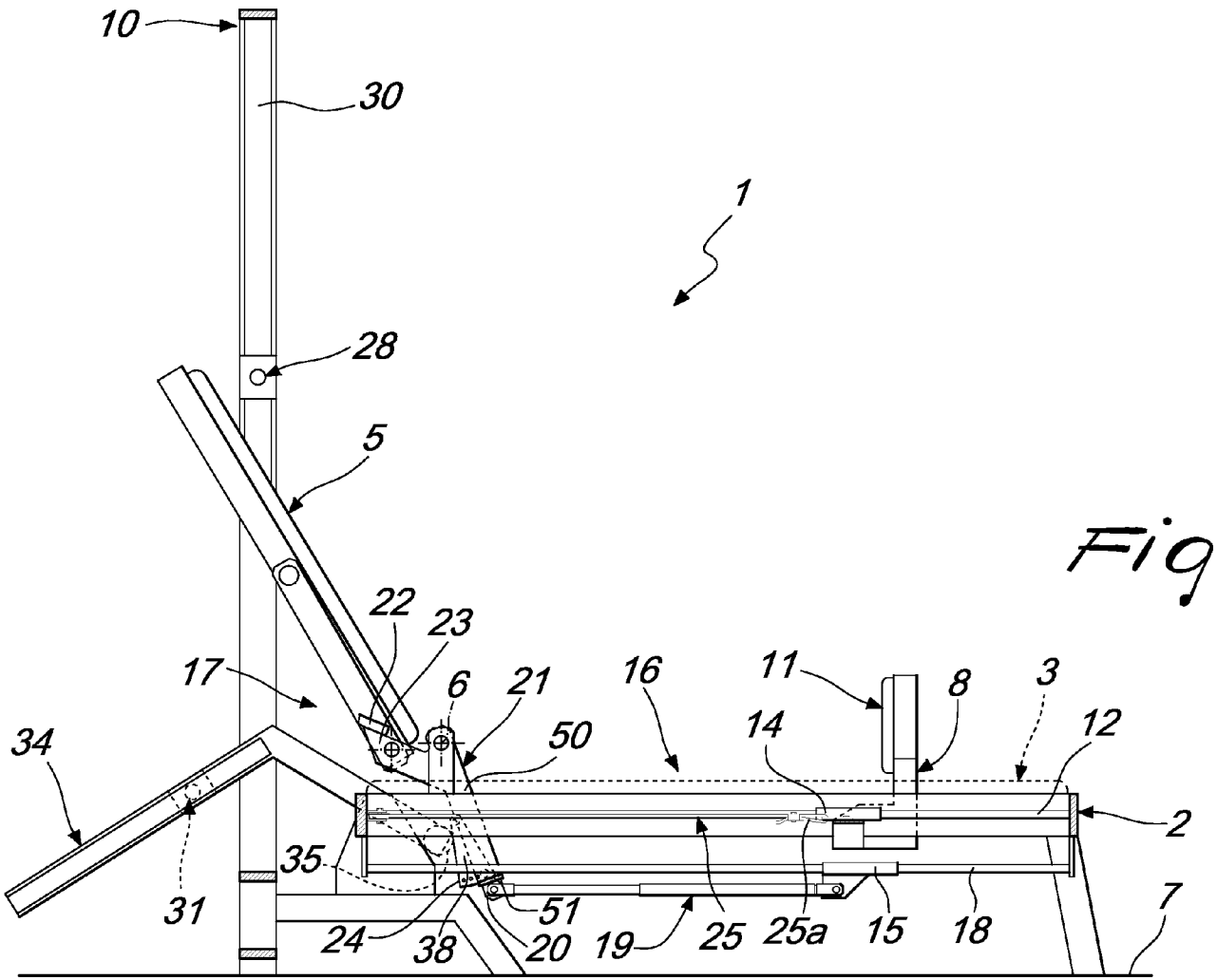
FIG. 2 is a side elevation view of the machine for gymnastic exercises shown in FIG. 1.
Figure 3:
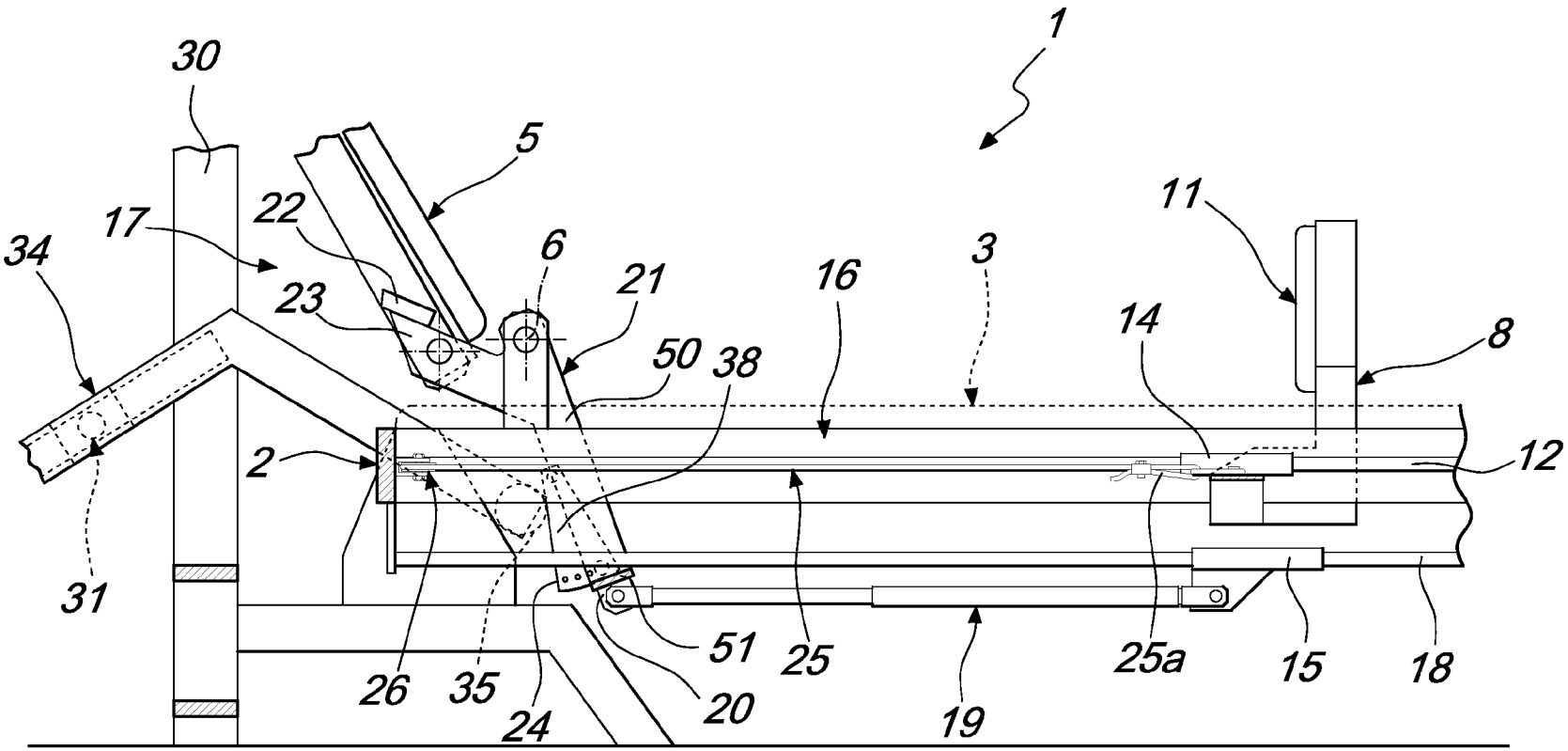
FIG. 3 is an enlarged-scale view of a detail of the machine for gymnastic exercises shown in FIG. 2.
Figure 4:
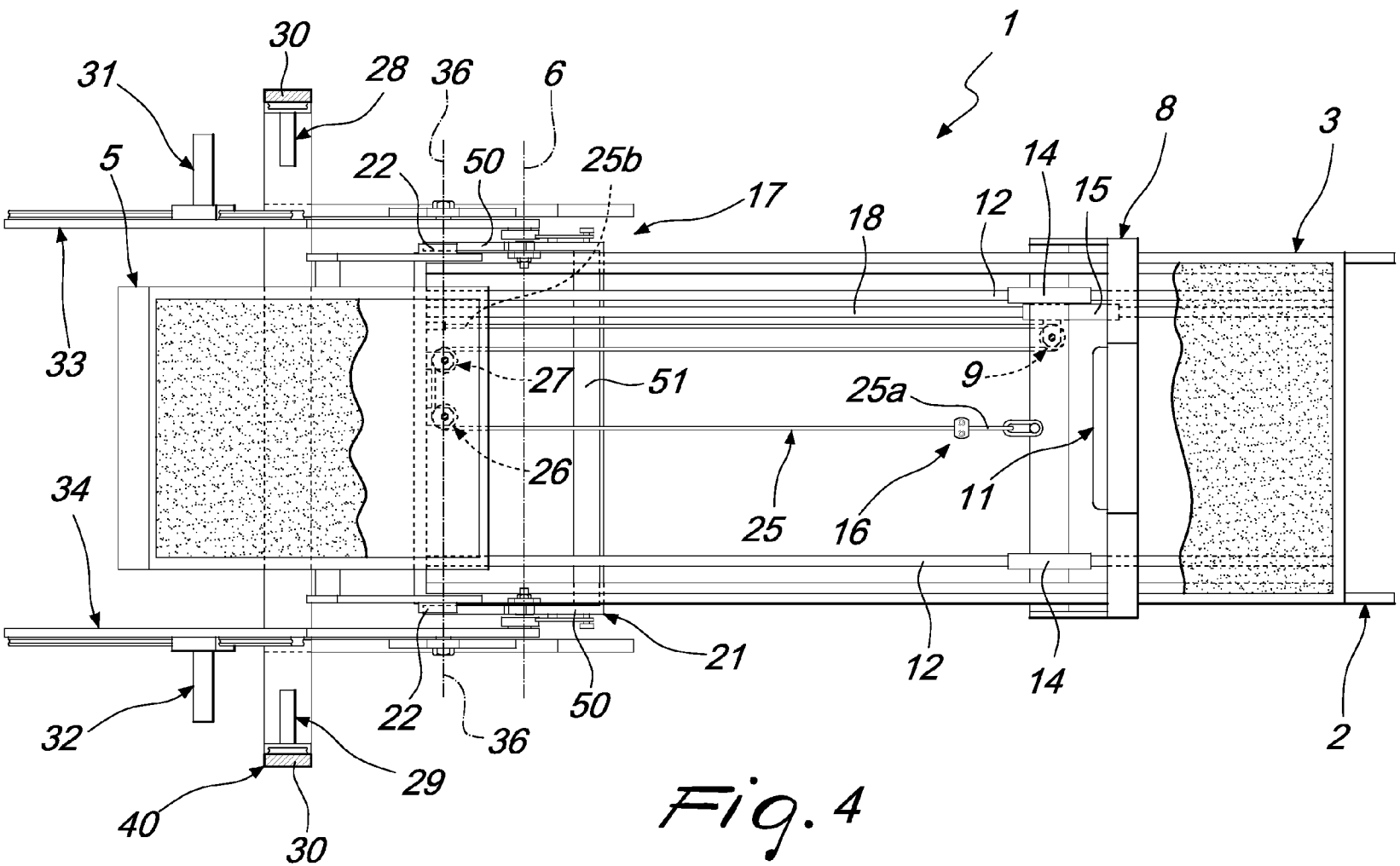
FIG. 4 is a plan view of the machine for gymnastic exercises shown in FIG. 1.
Figure 5:
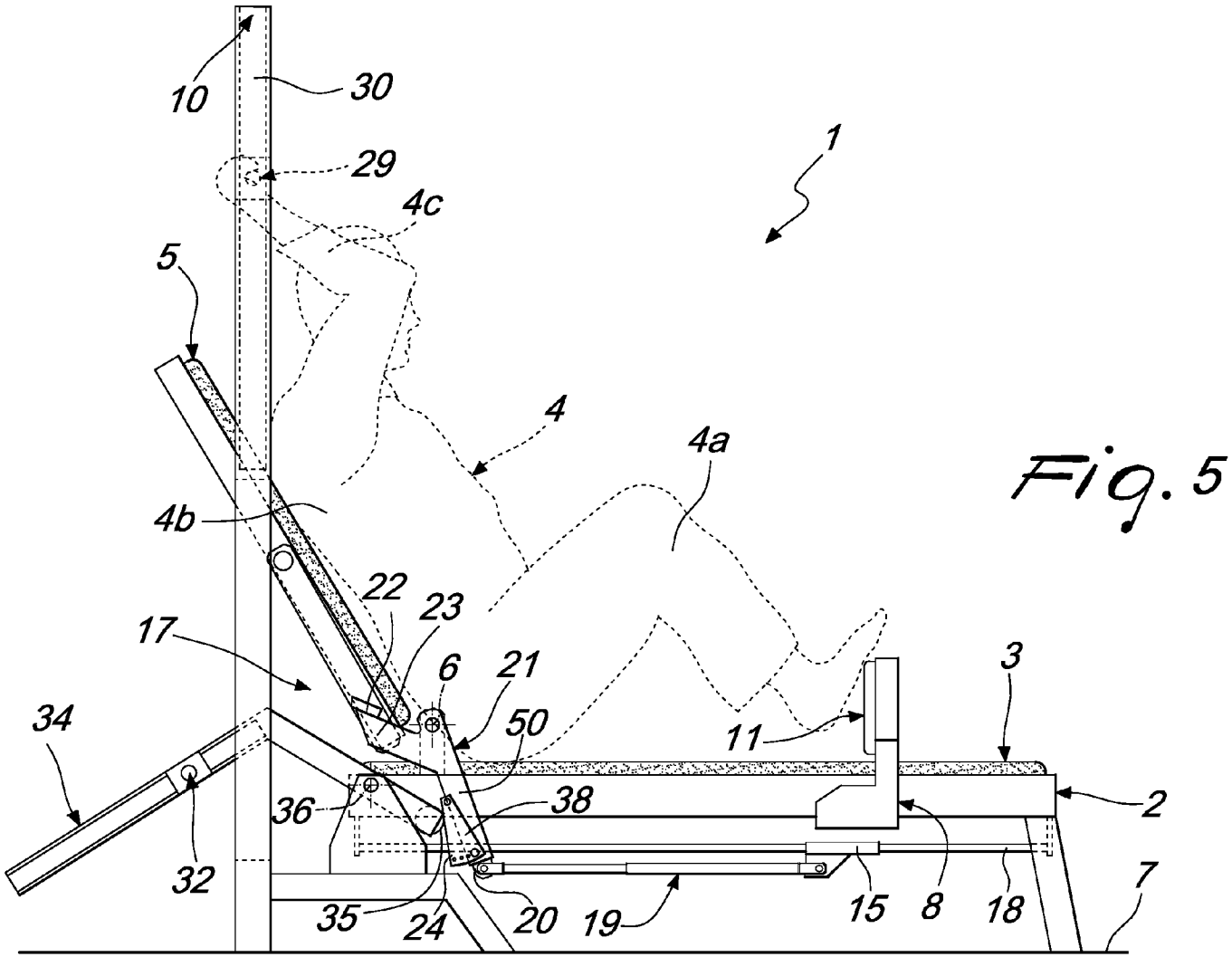
FIG. 5 is a side elevation view of the machine for gymnastic exercises, shown, according to the invention, during a first use thereof with the back rest in the substantially inclined position with respect to the seat.
Figure 6:
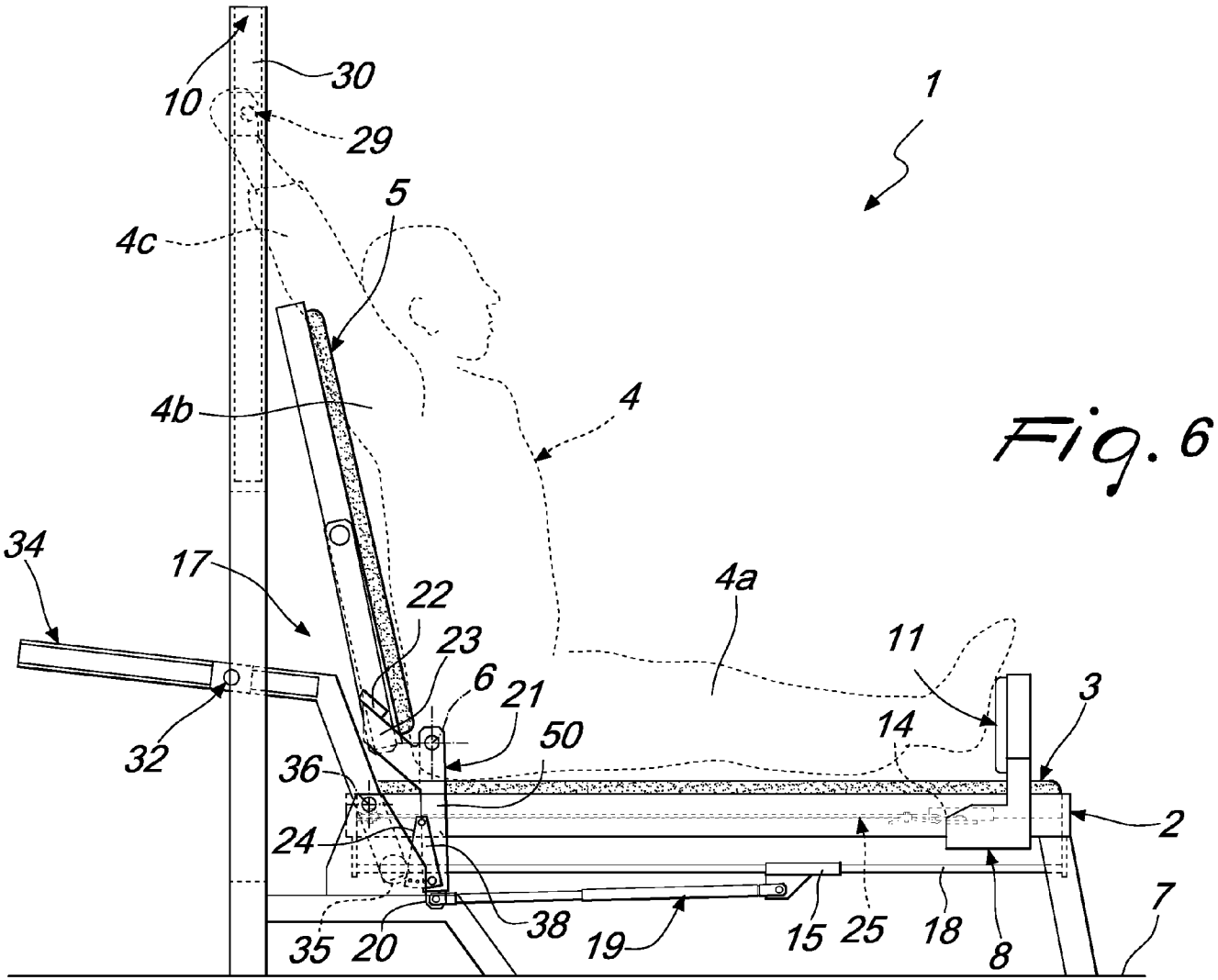
FIG. 6 is a side elevation view of the machine for gymnastic exercises shown, according to the invention, during the first use thereof with the back rest in the position which is substantially perpendicular with respect to the seat.
Figure 7:
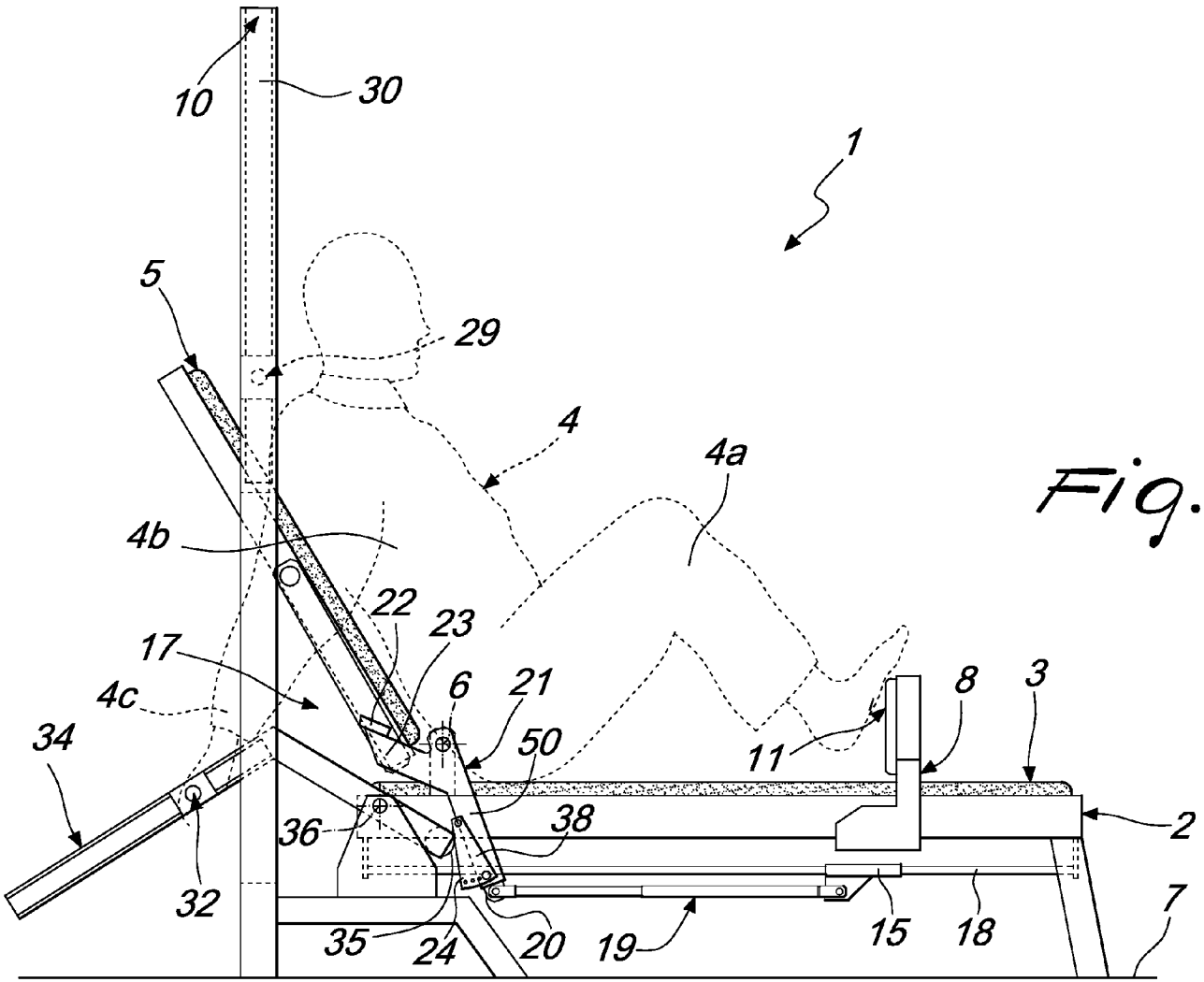
FIG. 7 is a side elevation view of the machine for gymnastic exercises shown, according to the invention, during a second use thereof with the back rest in the position which is substantially inclined with respect to the seat.
Figure 8:
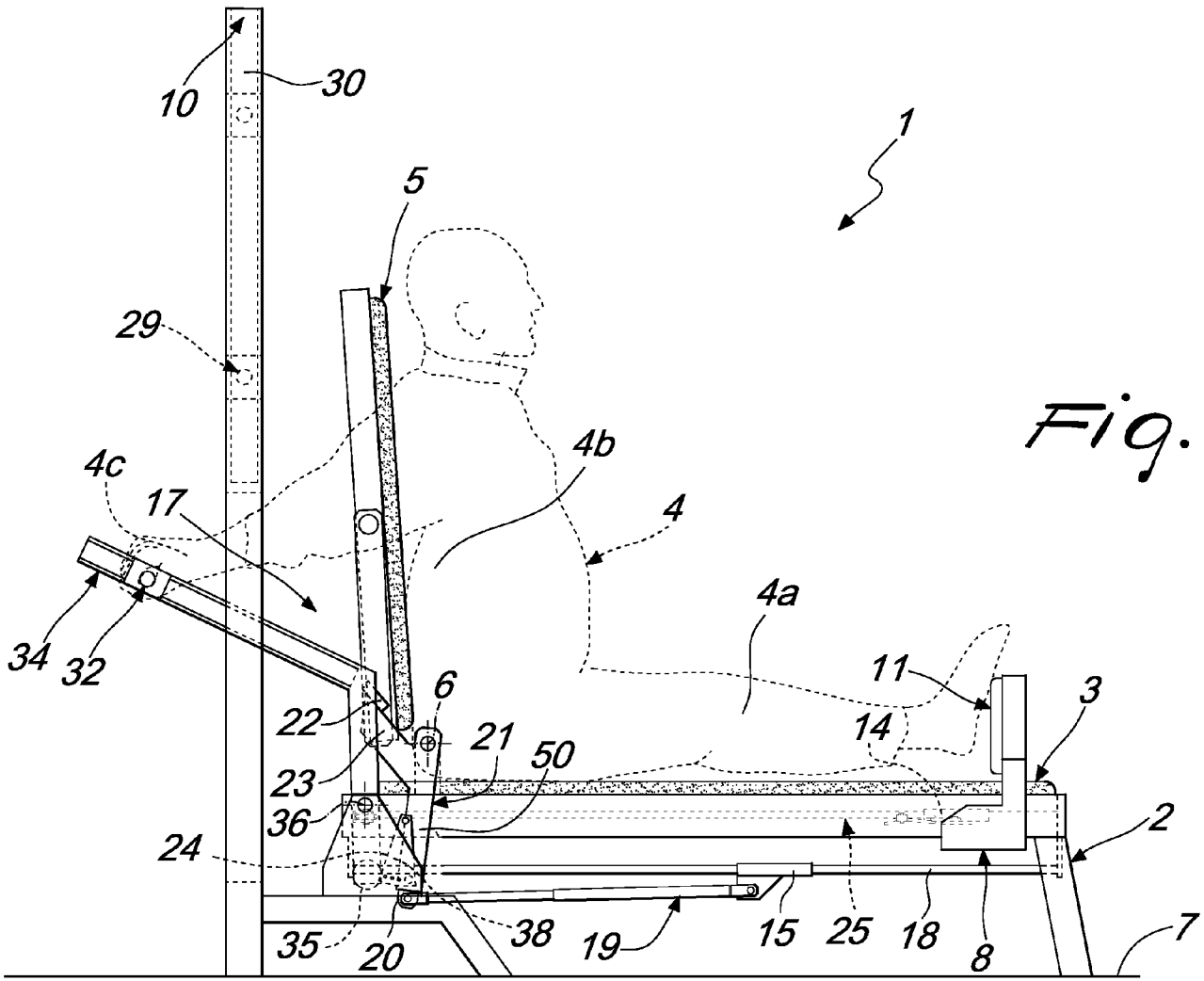
FIG. 8 is a side elevation view of the machine for gymnastic exercises shown, according to the invention, during the second use thereof, with the back rest in the position which is substantially perpendicular with respect to the seat.

With reference to the figures, the machine for gymnastic exercises, particularly for muscle stretching, generally designated by the reference numeral 1, comprises a supporting frame 2, which is jointly connected to a seat 3, which defines a sitting surface for a user 4, and a back rest 5, which is pivoted to the supporting frame 2 about a pivoting axis 6 for moving the back rest 5 between a position which is substantially inclined with respect to the seat 3, preferably equal to approximately 135°, and a position which is substantially perpendicular with respect to the seat 3.

More specifically, the supporting frame 2 can be provided by a metal structure, obtained for example from mutually welded bars, which defines a support for the seat 3 so as to make such seat parallel to the resting surface 7 of the machine 1 as shown in the figures.

Of course, this orientation with respect to the resting surface 7 is in no way limiting; indeed, possible variations of the machine 1 can provide for a seat 3 which is not parallel to the resting surface 7 of the machine 1 but is instead inclined with respect thereto without altering the inventive concept on which the machine 1 is based.

According to the invention, the movement of the back rest 5 with respect to the seat 3 is achieved by way of the presence of a carriage 8, which is slidingly associated with the supporting frame 2 and is functionally connected to the back rest 5 by way of kinematic connection means which are adapted to transfer the motion of the carriage 8 to the back rest 5 and/or vice versa.

As will be described in greater detail hereinafter, the movement of the carriage 8 is provided directly by the user 4 of the machine 1, who, when seated on the seat 3, pushes by means of his/her lower limbs 4*a* the carriage 8 in the opposite direction with respect to the back rest 5.

To achieve this, the carriage 8 is provided with a pushing footboard 11, which is arranged above the sitting surface of the seat 3 so that it can be actuated easily by the user 4 of the machine 1.

More precisely, the carriage 8 can move with respect to the seat 3 from a position that is proximate to the back rest 5 and corresponds to the position of the back rest 5 when it is inclined at 135° with respect to the seat 3, to a position that is spaced from the back rest 5 and corresponds to the position of the back rest 5 when it is arranged perpendicular to the seat 3, as a consequence of the thrust applied by the user 4 to the pushing footboard 11 of the carriage 8 away from the back rest 5 in contrast with the weight of the trunk 4*b* of the user 4 that bears on the back rest 5 and also in contrast with the reaction thrust that the user 4 applies to the back rest 5 in order to be able to push the pushing footboard 11.

In greater detail, the supporting frame 2 comprises two straight guides 12, which are oriented parallel to the sitting surface of the seat 3 and along which the carriage 8 can slide.

In the proposed embodiment, such guides 12 run below the sitting surface of the seat 3 and engage two sliding members 14 which are integrally connected to the carriage 8 in translational motion.

Preferably, the carriage 8 has a C-shaped structure which surrounds the seat 3 in an upward region and forms, respectively at its ends and at its central part, the sliding members 14 and the pushing footboard 11.

Advantageously, the kinematic connection means 9 comprise at least one slider 15, which is slidingly associated with the supporting frame 2 along a direction that is substantially parallel to the direction of translational motion of the carriage 8, and transmission means 16, which are functionally connected to the carriage 8 and to the slider 15 in order to transmit the translational motion of the carriage 8 to the slider 15 and/or vice versa.

Moreover, the kinematic connection means 9 also comprise at least one lever system 17, which is functionally connected to the slider 15 and to the back rest 5 in order to convert the translational motion of the slider 15 into a rotary motion of the back rest 5 about its own pivoting axis 6 with respect to the supporting frame 2.

In the proposed embodiment, the slider 15 is constituted by a sliding member that is guided slidingly on a straight guide 18, which is oriented parallel to the guides 12, and is arranged laterally and downwardly with respect to the sitting surface of the seat 3.

Advantageously, the lever system 17 comprises a linkage 19 which is interposed between the slider 15 and an end 20 of a first-class lever 21, which is pivoted to the supporting frame 2 in proximity to the pivoting axis 6 between the back rest 5 and the supporting frame 2 and is integrally connected in rotation to the back rest 5 at least in the transition from the substantially inclined position of the back rest 5 with respect to the seat 3 to the substantially perpendicular position of the back rest 5 with respect to the seat 3.

More precisely, this constraint in rotation is provided by the presence of an abutment element 22, which is arranged on the lateral edge of the back rest 5 and can engage, by resting against, the end 23 of the first-class lever 21 that lies opposite to the end 20 with respect to the pivoting axis of the first-class lever 21 to the supporting frame 2, which coincides substantially with the pivoting axis 6 of the back rest 5 with respect to the supporting frame 2.

Moreover, in order to optimize the ergonomics of the machine 1 in relation to the height of the user 4, the length of the linkage 19 is adjustable by way of first adjustment means which are provided for example by a coupling of the telescopic type between two bars that constitute such linkage 19.

In the proposed embodiment, the first-class lever 21 is constituted by two lateral plates 50, which are arranged laterally to the back rest 5 and are mutually connected by a cross-member 51 such as to integrally connect them to each other.

In this manner, even though the linkage 19 acts only on one side of the first-class lever 21, both of the lateral plates 50 engage the back rest 5 and a respective abutment element 22.

As regards the transmission means 16, these comprise at least one cable 25, which is pivoted at its ends 25*a* and 25*b*, respectively, to the carriage 8 and to the supporting frame 2.

Such cable 25 is partially wound onto a plurality of pulleys, one of which can move with respect to the supporting frame 2, integrally with the slider 15, while the others are fixed to the supporting frame 2 for the translational motion of the slider 15 in a direction that is opposite with respect to the direction of translational motion of the carriage 8.

Advantageously, this kinematic reversal is achieved thanks to the fact that, starting from the end 25*a* that is pivoted to the carriage 8 toward the end 25*b* that is pivoted to the supporting frame 2, the cable 25 winds around two guiding pulleys 26 and 27, which are fixed with respect to the supporting frame 2, and around a movable pulley 9, which can move integrally with the slider 15 between two portions of the cable 25.

The arrangement of the guiding pulleys 26 and 27 and the length of the cable 25 are such as to allow movement of the carriage 8 and of the slider 15 without their coming into contact with the other elements of the machine 1.

In order to stretch the muscles of the posterior kinematic chain of the user 4 simultaneously with the stretching of the posterior muscles caused by the extension of the lower limbs 4*a* with the voluntary action of moving the lower limbs 4*a* in engagement with the pushing footboard 11, the machine 1 comprises first elements 28 and 29, which can be gripped by the user 4 above the back rest 5 with respect to the side where the user 4 sits.

More precisely, the first elements 28 and 29 consist of two knobs which are arranged laterally to the back rest 5 and are associated slidingly with the posts 30 of a bunk bed-like frame 10, which is part of the supporting frame 2 and is arranged above the back rest 5, along a direction that is substantially perpendicular to the direction of translational motion of the carriage 8.

Similarly, the machine 1 comprises second elements 31 and 32 that can be gripped by the user 4 below the back rest 5 with respect to the side where the user 4 sits.

Differently from the first elements 28 and 29, the second elements 31 and 32 consist of two knobs which are arranged laterally to the back rest 5 and are slidingly associated with two respective arms 33 and 34, which are pivoted to the supporting frame 2 on two opposite sides of the back rest 5.

In greater detail, the two arms 33 and 34 extend to the rear and along a direction that is substantially inclined with respect to the back rest 5 and they can rotate simultaneously with the rotation of the back rest 5 at least in the transition from the substantially inclined position of the back rest 5 with respect to the seat 3 to the substantially perpendicular position of the back rest 5 with respect to the seat 3.

More precisely, this constraint in rotation is provided by the presence of a sliding roller 35, one for each of the arms 33 and 34 which is arranged, with respect to a pivoting axis 36 of the arms 33 and 34 with respect to the supporting frame 2, on the opposite side with respect to the second elements 31 and 32, and this sliding roller 35 can engage, by rolling on it, a respective gliding track 24 that is defined on the first-class lever 21 at its end 20 for the rotation of the respective arm 33 or 34 with respect to the supporting frame 2 in the transition of the back rest 5 from the substantially inclined position thereof with respect to the seat 3 to the substantially perpendicular position of the back rest 5 with respect to the seat 3.

As shown in the figures, it should be specified that between the pivoting axis 6 of the back rest 5 and the pivoting axis 36 of the two arms 33 and 34 there is an eccentricity which causes the rotations of the arms 33 and 34 about the pivoting axis 36 to be greater than the rotation imparted to the back rest 5 about the pivoting axis 6, as will be described in greater detail hereinafter, thus facilitating the opening of the flexing angle of the upper limbs 4*c* of the user 4.

As with the linkage 19, in order to optimize the ergonomics of the machine 1 in relation to the height of the user 4, second means are provided for adjusting the relative angle between the arms 31 and 32 and the first-class lever 21.

In greater detail, such second adjustment means consist of two oscillating plates 38, on which the gliding tracks 24 are defined, which are pivoted to the first-class lever 21 so as to be able to assume different angles with respect to the first-class lever 21. The selected angle is maintained by way of a pivot which can be inserted in succession in a hole which is selected from a plurality of holes that are defined in the oscillating plate 38 and a hole that is present in the first-class lever 21.

In a possible variation of the machine 1, the kinematic connection between the carriage 8 and the back rest 5, besides being of a mechanical type, can be supplemented by or replaced completely with pneumatically and/or a hydraulically and/or electrically actuated means, which can be deduced easily by the person skilled in the art.

Operation of the machine for gymnastic exercises 1, particularly for muscle stretching, is described hereinafter.

Starting from a configuration in which the back rest 5 is arranged in its inclined position, for example at 135° with respect to the seat 3, the user 4 sits on the sitting surface of the seat 3 with his/her back resting against the back rest 5.

In this configuration, the carriage 8 is arranged in its portion proximate to the back rest 5, forcing the user 4 to bend his/her lower limbs 4*a*, by bringing substantially his/her knees to his/her chest, so as to be able to rest the soles of his/her feet on the pushing footboard 11.

At his/her choice, depending on whether he/she wishes to extend or flex the scapulohumeral cingulum, the user 4 can grip with his/her hands the knobs respectively of the first elements 28 and 29 or of the second elements 31 and 32.

In any case, by pushing the pushing footboard 11 with a movement for extending the lower limbs 4*a*, the user 4 forces the carriage 8 to slide along its straight guides 12 and, at the same time, straightens the back rest 5, moving it to its position which is perpendicular with respect to the seat 3 in contrast with the weight of the trunk 4*b* of the user 4 which bears on the back rest 5, and in contrast with the reaction thrust that the user 4 applies to the back rest 5 in order to be able to push the pushing footboard 11.

During this movement, the upper limbs 4*c* also are stretched, thus extending or flexing the scapulohumeral cingulum.

By then returning the knees to the chest, as a consequence of the weight of the trunk 4*b* of the user 4 that bears on the back rest 5, the back rest 5 returns to its initial position, also returning the carriage 8 to its initial position.

Figure 9:
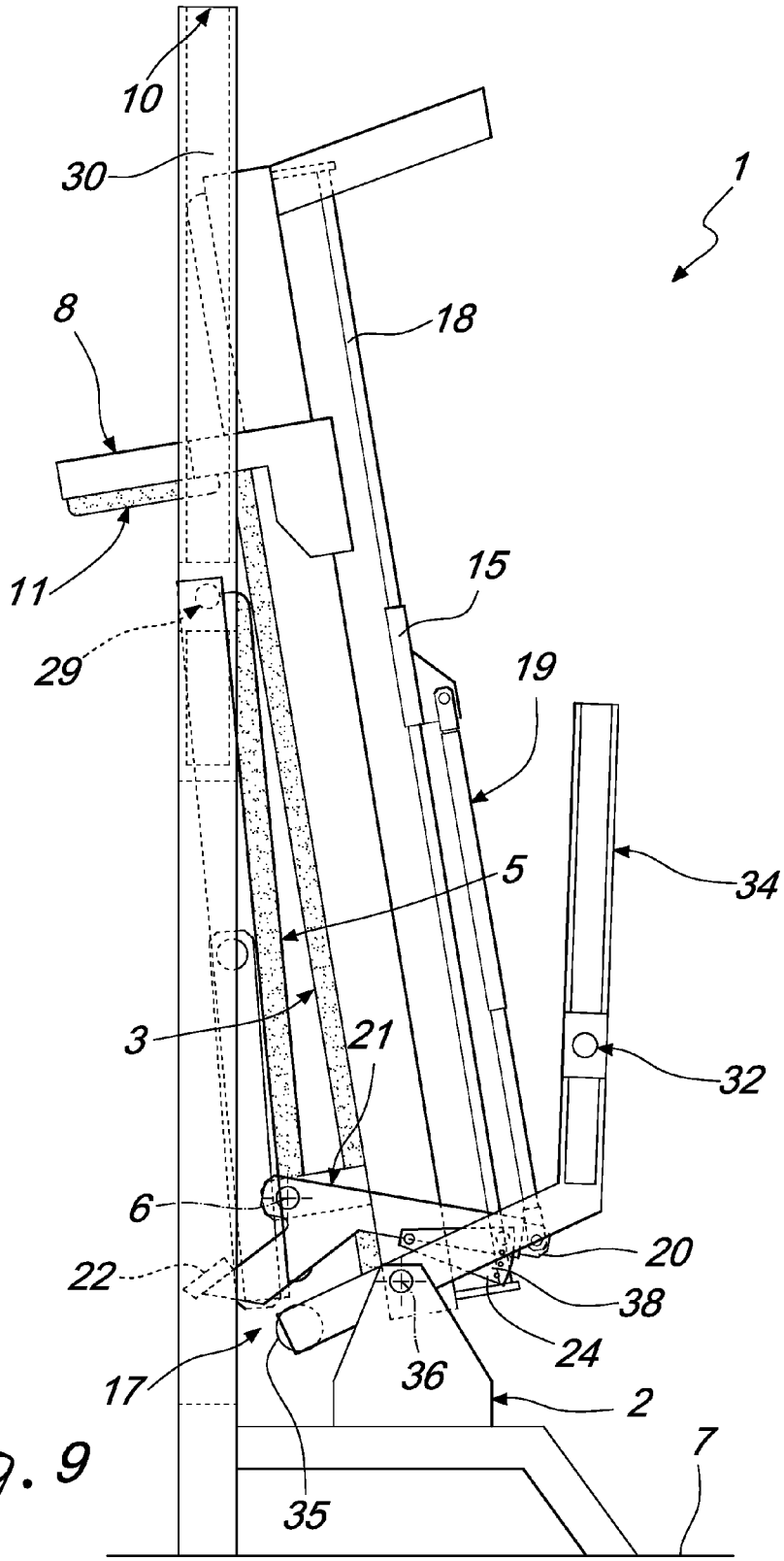
FIG. 9 is a side elevation view of the machine for gymnastic exercises shown in FIG. 1 folded up.

In order to limit occupation of space when not in use, the various different parts of the machine 1 can be provided in separate and mutually pivoted pieces so that the machine can be folded up if necessary, as shown in FIG. 9.

In practice it has been found that the machine for gymnastic exercises, particularly for muscle stretching, according to the present invention, fully achieves the intended aim and objects, since as a consequence of a voluntary action of extending the lower limbs it makes it possible to stretch the muscles and joints of the posterior kinematic chain, thus providing obvious benefits to the physical condition of the user.

More precisely, the combined action that involves all the joints of the posterior kinematic chain, from the ankles to the wrists of the user, makes it possible to remove tension from the spinal column and to produce a beneficial feeling for all the joints involved, helping to prevent processes of osteoarthritis and joint degeneration.

Another advantage of the machine for gymnastic exercises according to the present invention consists in the fact that it is structurally simple and easy to make at competitive costs.

The machine for gymnastic exercises, particularly for muscle stretching, thus conceived is susceptible of numerous modifications and variations, all of which are within the scope of the appended claims.

All the details may further be replaced with other, technically equivalent elements.

In practice, the materials used, so long as they are compatible with the specific use, as well as the contingent shapes and dimensions, may be any according to requirements and to the state of the art.

The disclosures in Italian Patent Application No. MI2009A002267 from which this application claims priority are incorporated herein by reference.

What is claimed is:

1. A machine for gymnastic exercises, particularly for muscle stretching, comprising a supporting frame, a seat which is fixed with respect to said supporting frame, and a back rest which is pivoted to said supporting frame for moving said back rest between a position which is substantially inclined with respect to said seat and a position which is substantially perpendicular with respect to said seat, the machine further comprising a carriage which is slidingly associated with said supporting frame so as to have a translational motion and which is functionally connected to said back rest by way of kinematic connection means for transferring the translational motion of said carriage to said back rest and/or vice versa, a pushing footboard being provided on said carriage in a position above a sitting surface of said seat such that said pushing footboard is arranged for being actuated by being pushed by a user's lower limbs to provide said translational motion of said pushing footboard and of said carriage.

2. A machine for gymnastic exercises, particularly for muscle stretching, comprising a supporting frame, a seat which is fixed with respect to said supporting frame, and a back rest which is pivoted to said supporting frame for moving said back rest between a position which is substantially inclined with respect to said seat and a position which is substantially perpendicular with respect to said seat, the machine further comprising a carriage which is slidingly associated with said supporting frame and is functionally connected to said back rest by way of kinematic connection mean for transferring the motion of said carriage to said back rest and/or vice versa, said kinematic connection means comprising at least one slider which is slidingly associated with said supporting frame along a direction which is substantially parallel to the direction of translational motion of said carriage, transmission means which are functionally connected to said carriage and to said at least one slider for the transmission of the translational motion of said carriage to said at least one slider, and at least one lever system, which is functionally connected to said at least one slider and to said back rest for the conversion of the translational motion of said at least one slider into a rotary motion of said back rest about its own pivoting axis with respect to said supporting frame.

3. The machine according to claim 2, wherein said lever system comprises a linkage which is interposed between said at least one slider and an end of a first-class lever which is integrally connected for rotation to said back rest at least in the transition from said substantially inclined position of said back rest with respect to said seat to said substantially perpendicular position of said back rest with respect to said seat, said first-class lever being pivoted to said supporting frame at said pivoting axis between said back rest and said supporting frame.

4. The machine according to claim 3, further comprising means for adjusting the length of said linkage for the ergonomic optimization of said machine in relation to the height of said user.

5. The machine according to claim 2, wherein said transmission means comprise at least one cable which is pivoted at its ends, respectively, to said carriage and to said supporting frame and is partially wound around a plurality of pulleys, one of which is movable with respect to said supporting frame integrally with said at least one slider, while the other pulleys being fixed to said supporting frame for the translational motion of said at least one slider in a direction that is opposite with respect to the direction of translational motion of said carriage.

6. The machine according to claim 5, wherein, starting from an end of said at least one cable that is pivoted to said carriage toward an end of said at least one cable that is pivoted to said supporting frame, said at least one cable winds around two guiding pulleys, which are fixed to said supporting frame, and around a pulley which is movable between two portions of said at least one cable jointly with said at least one slider.

7. A machine for gymnastic exercises, particularly for muscle stretching, comprising a supporting frame, a seat which is fixed with respect to said supporting frame, and a back rest which is pivoted to said supporting frame for moving said back rest between a position which is substantially inclined with respect to said seat and a position which is substantially perpendicular with respect to said seat, the machine further comprising a carriage which is slidingly associated with said supporting frame and is functionally connected to said back rest by way of kinematic connection mean for transferring the motion of said carriage to said back rest and/or vice versa, the machine further comprising elements which can be gripped by said user above said back rest with respect to the side where said user sits and are associated slidingly with said supporting frame along a direction which is substantially perpendicular to the direction of translational motion of said carriage.

8. A machine for gymnastic exercises, particularly for muscle stretching, comprising a supporting frame, a seat which is fixed with respect to said supporting frame, and a back rest which is pivoted to said supporting frame for moving said back rest between a position which is substantially inclined with respect to said seat and a position which is substantially perpendicular with respect to said seat, the machine further comprising a carriage which is slidingly associated with said supporting frame and is functionally connected to said back rest by way of kinematic connection mean for transferring the motion of said carriage to said back rest and/or vice versa, the machine further comprising elements, which can be gripped by said user below said back rest with respect to the side where said user sits and are associated slidingly with two respective arms which are hinged to said supporting frame on two opposite sides of said back rest, which extend to the rear and along a direction which is substantially inclined with respect to said back rest and can rotate simultaneously with the rotation of said back rest at least in the transition from said substantially inclined position of said back rest with respect to said seat to said substantially perpendicular position of said back rest with respect to said seat.

9. The machine according to claim 8, further comprising, for each of said arms, a sliding roller, which is arranged, with respect to a pivoting axis of said arms with respect to a supporting frame, on the opposite side with respect to said elements and can engage, by rolling on, a respective gliding track defined on said first-class lever at said end for the rotation of the respective arm of said arms with respect to said supporting frame in the transition of said back rest from said substantially inclined position of said back rest with respect to said seat to said substantially perpendicular position of said back rest with respect to said seat.

10. The machine according to claim 9, further comprising means for adjusting the relative angle between said arms and said first-class lever for the ergonomic optimization of said machine in relation to the height of the user.

* * * * *